US005834909A

United States Patent [19]

Marmonier

[11] Patent Number: 5,834,909

[45] Date of Patent: Nov. 10, 1998

[54] DEVICE FOR ACTUATING ELECTRICAL EQUIPMENT, IN PARTICULAR A HIGH-VOLTAGE SECTION SWITCH OR A HIGH-VOLTAGE GROUNDING SECTION SWITCH

[75] Inventor: Jean Marmonier, Aix Les Bains, France

[73] Assignee: GEC Alsthom T & D SA, Paris, France

[21] Appl. No.: 678,268

[22] Filed: Jul. 11, 1996

[30] Foreign Application Priority Data

Jul. 12, 1995 [FR] France ..... 95 08436

[51] Int. Cl.[6] ..... H01H 3/22

[52] U.S. Cl. ..... 318/17; 318/264; 200/329; 74/625

[58] Field of Search ..... 318/3, 17, 264, 318/265, 266, 286, 466, 467, 468; 200/17 R, 18, 47, 329; 74/625; 361/605

[56] References Cited

U.S. PATENT DOCUMENTS 4,444,067 4/1984 Preuss et al. .
4,804,809 2/1989 Thompson, Jr. et al. .
5,025,171 6/1991 Fanta et al. .
5,034,584 7/1991 Fanta et al. .
5,254,814 10/1993 Harr .

FOREIGN PATENT DOCUMENTS

0557795A1 9/1993 European Pat. Off. .
2591026A1 6/1987 France .
2410641 9/1975 Germany .

*Primary Examiner*—Bentsu Ro
*Attorney, Agent, or Firm*—Sughrue, Mion, Zinn, Macpeak & Seas, PLLC

[57] ABSTRACT

A system for actuating electrical equipment, in particular a high-voltage section switch or a high-voltage grounding section switch includes, in a control box, a rotary drive unit for driving the contacts of the equipment. A control circuit includes "end-of-stroke" contacts associated with the contacts of the equipment. The system includes a portable electric motor having a self-contained power supply. The motor is equipped with a mechanical coupling for mechanically coupling the motor to the rotary drive unit, and is provided with an electrical connector for connecting the motor to the control circuit.

8 Claims, 5 Drawing Sheets

DEVICE FOR ACTUATING ELECTRICAL EQUIPMENT, IN PARTICULAR A HIGH-VOLTAGE SECTION SWITCH OR A HIGH-VOLTAGE GROUNDING SECTION SWITCH

The present invention relates to a system for actuating electrical equipment, in particular a high-voltage section switch or a high-voltage grounding section switch.

The present invention relates more precisely to a system for actuating electrical equipment, in particular a high-voltage section switch or a high-voltage grounding section switch, the system including, in a control box, a rotary drive device for driving the contacts of the high-voltage equipment, and a control circuit including "end-of-stroke" contacts associated with the contacts of the equipment.

BACKGROUND OF THE INVENTION

Such a high-voltage section switch or grounding section switch is generally actuated electrically by means of an electric motor operated from a local control cabinet, and associates with a control circuit including contacts controlled by a position-indicating circuit associated with the contacts of the equipment.

The "open" or "close" command is transmitted from the cabinet, and the motor is stopped by the contacts of the control circuit.

In conventional manner, the actuating electric motor is fixed inside a control box including a coupling making it possible for a back-up crank handle to be coupled in the event that the motor or its power supply fails or that a fault occurs in the control voltage of the control contactors. When the crank handle is coupled, the mechanical coupling guarantees that the motor is electrically disconnected.

Such manual crank-handle operation poses two types of problem.

Firstly, the rotation speed of the crank handle cannot be imposed, and it may therefore by excessively slow or excessively fast. The electrical performance level of the section switch cannot therefore be guaranteed, in particular during a transfer operation under load with stations having two sets of bars, for example. Furthermore, the position-indicating contacts which must be positive-acting for reasons of reliability might open if the contacts separate too slowly when interrupting large inductive-type currents. During opening of the section switch contacts, if the contacts separate too slowly, an arc stresses the contacts for too long, and damages them.

Secondly, full opening or closing is not guaranteed, and, at the end of the opening or closing operation impacts might occur between mechanical abutments, possibly at full speed, which damages the contacts. This is particularly problematic in shielded equipment, i.e. metal-clad equipment, in which the contacts are hidden and the operation must be performed blind.

OBJECTS AND SUMMARY OF THE INVENTION

To solve those problems, the invention provides a system in which the crank handle is replaced with a portable electric motor having a self-contained power supply, which motor is equipped with a mechanical coupling for mechanically coupling it to a rotary drive unit, and is provided with an electrical connector for connecting it to the control circuit.

Given that the speed of the portable motor is known and is constant, the first type of problem is solved. By being connected to the control circuit, the portable motor can be stopped automatically at the end of the opening or closing operations, thereby solving the second type of problem.

For reasons of availability or compactness, the portable motor may be used as an actuating device under normal operating conditions.

Preferably, said motor is housed in a casing of the power drill type, and said mechanical coupling is a rod of the crank rod type serving to co-operate with the mechanical drive device of the box.

Advantageously, said electrical connector is a plug designed to be plugged into the box, and connecting said control circuit to a portable-motor control circuit housed in the casing.

Said portable-motor control circuit is preferably actuated via two push buttons, and it causes the motor to rotate in one or other rotation direction.

Said control box may further include a link to a locking relay designed to be connected to said plug, and straps for determining the direction of the operation, and designed to be connected to said plug.

In a preferred embodiment, the actuating system constitutes a back-up system for actuating electrical equipment in the event that a normal actuating system including a fixed electric motor associated with said control box malfunctions.

In which case, said control box advantageously includes a removable plug for normal operation, which plug provides continuity for the fixed-motor control circuit.

BRIEF DESCRIPTION OF THE DRAWINGS

A preferred embodiment of the invention is described below in more detail with reference to the accompanying drawings, in which:

FIGS. 1A and 1B are diagrammatic views respectively in perspective and in section of a control box of the invention for controlling electrical equipment, the control box being shown in the normal operating posit on;

DETAILED DESCRIPTION

Figure 1A:
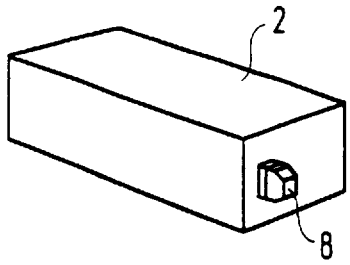
Figure 1B:
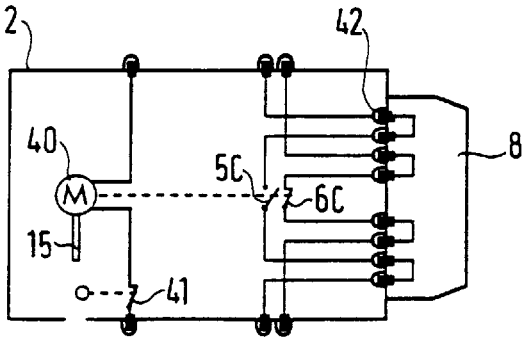

The control box 2 shown in FIGS. 1A and 1B is known per se except for the removable plug as described below.

The box 2 contains the fixed actuating motor 40 for normal operation of the electrical equipment, the motor being provided with a rotary drive device 15 serving in known manner for coupling with a back-up crank handle. A switch 41 is provided for disconnecting the motor 40 while a crank handle is being used.

"End-of-stroke" contacts 5C, 6C that are part of the control circuit for controlling the fixed motor 40 and that are connected to a local control cabinet (not shown) are controlled by a position-indicating circuit associated with the contacts of the equipment and guaranteeing firstly that the motor performs the operation in full, and secondly that the actuating motor stops at the end of the operation.

When the equipment is to operate, the operating command is transmitted from the local control cabinet to the motor 40, and the contacts 5C, 6C are operated at the end of opening or closing of the contacts of the equipment, so that the motor 40 ceases to operate.

According to the invention, the fixed-motor control circuit is split up and part of it is contained in a sealed plug 8 that can be unplugged from connector terminals 42. When it is plugged in, the plug 8 provides continuity for the fixed-motor control circuit and it connects the contacts 5C, 6C to the local control cabinet.

Figure 2A:
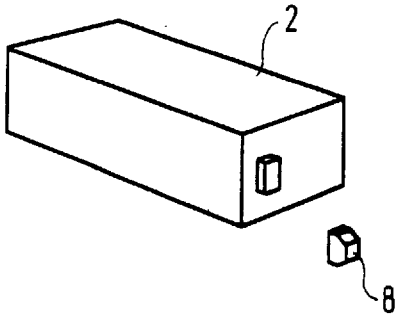
FIGS. 2A and 2B are diagrammatic views respectively in perspective and in section of the same control box shown in the intermediate position when a malfunction occurs.
Figure 2B:
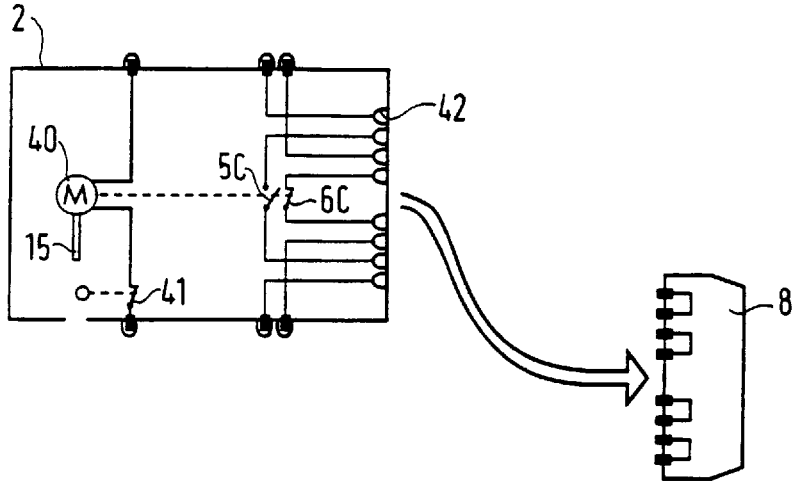

In the event that the actuating motor 40 or its power supply fails, or that there is a fault in the control voltage of the control contactors, the plug 8 is unplugged as shown in FIGS. 2A and 2B. The fixed-motor control circuit is then open and disconnected from the local control cabinet.

Figure 3A:
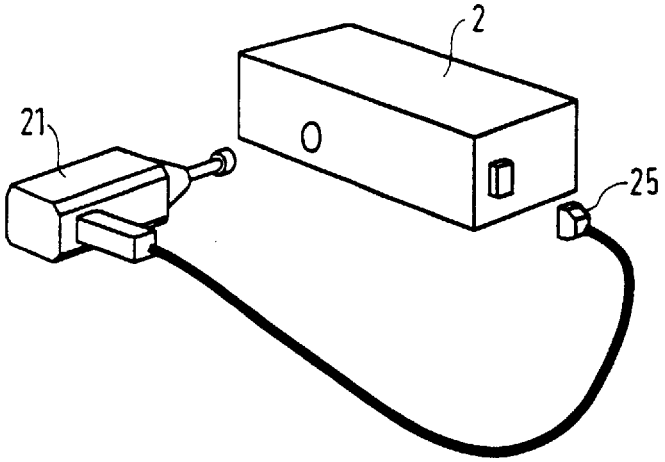
FIGS. 3A and 3B are diagrammatic views respectively in perspective and in section of the same control box to which the back-up actuating system of the invention is connected.
Figure 3B:
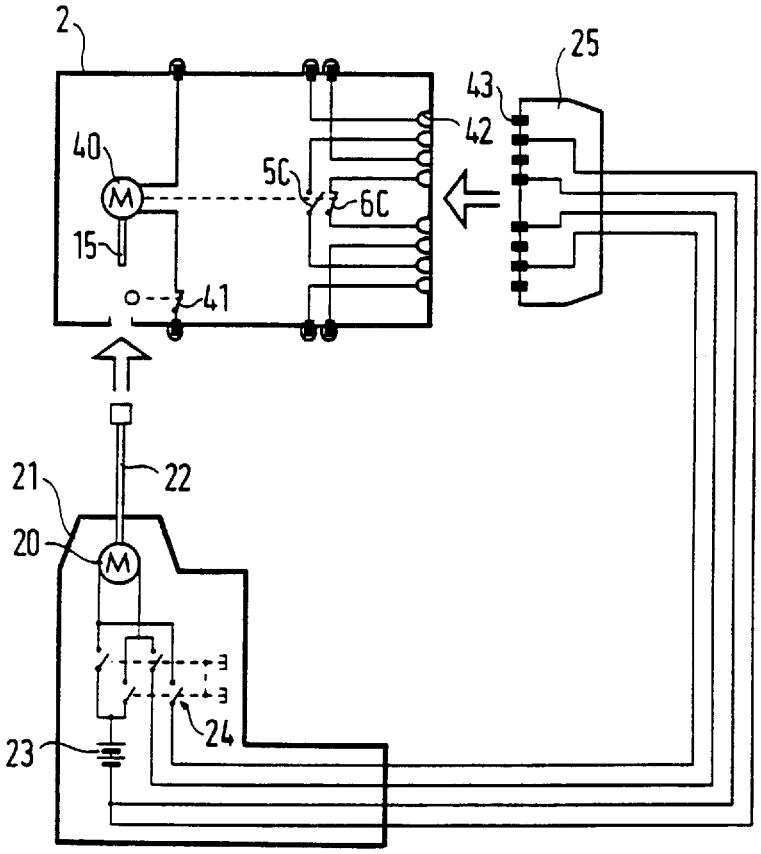

The actuating system in one form of the invention is then installed as a back-up system in one form, as shown in FIGS. 3A and 3B.

This system includes a portable electric motor 20 having a self-contained power supply 23, advantageously a battery, the system being equipped with a mechanical coupling 22 for coupling to the rotary drive device 15, and provided with an electrical connector 25 for connection to the released connector terminals 42.

The portable motor 20 is housed in a casing 21 of the power drill type, and the mechanical coupling 22 is a rod coupled to the rotor of the motor 20 and is of the crank rod type.

The connector 25 is a plug equipped with connector terminals 43 that can be plugged into the released connector terminals 42, some of the connector terminals 43 being connected to the motor 20 via an associated portable-motor control circuit 24 described below.

Figure 4:
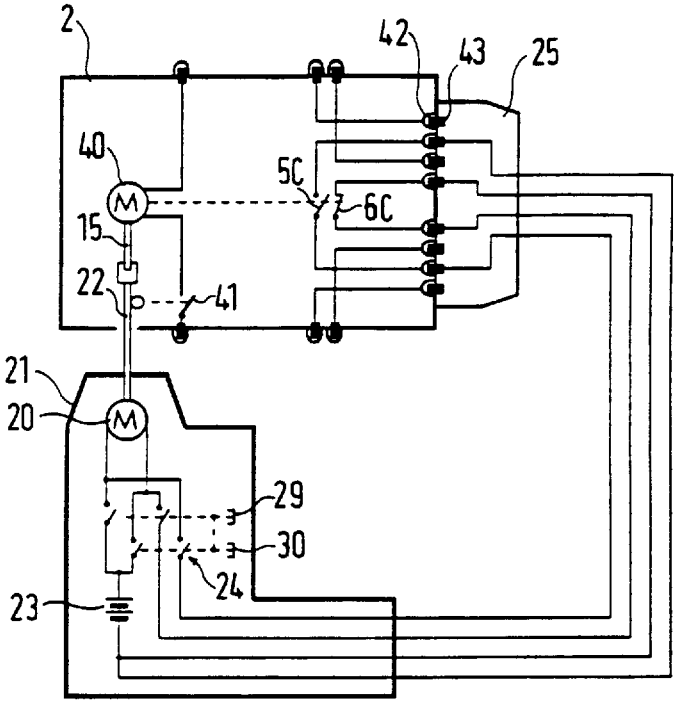
FIG. 4 is a diagrammatic view in section of the back-up actuating system connected to the control box.

FIG. 4 shows the back-up actuating system of FIGS. 3A and 3B connected to the box 2.

The fixed-motor control circuit with its contacts 5C, 6C is then connected to the portable motor 20, its connections to the local control cabinet being interrupted.

The portable motor 20 is actuated by the portable-motor control circuit 24 in one direction so as to drive the equipment contacts open by pushing button 29, and in the other direction so as to drive the equipment contacts closed by pushing button 30. The actuation is controlled by the contacts 5C and 6C of the box, which contacts stop the motor 20 once the contacts of the high-voltage equipment are fully open or fully closed.

Figure 5:
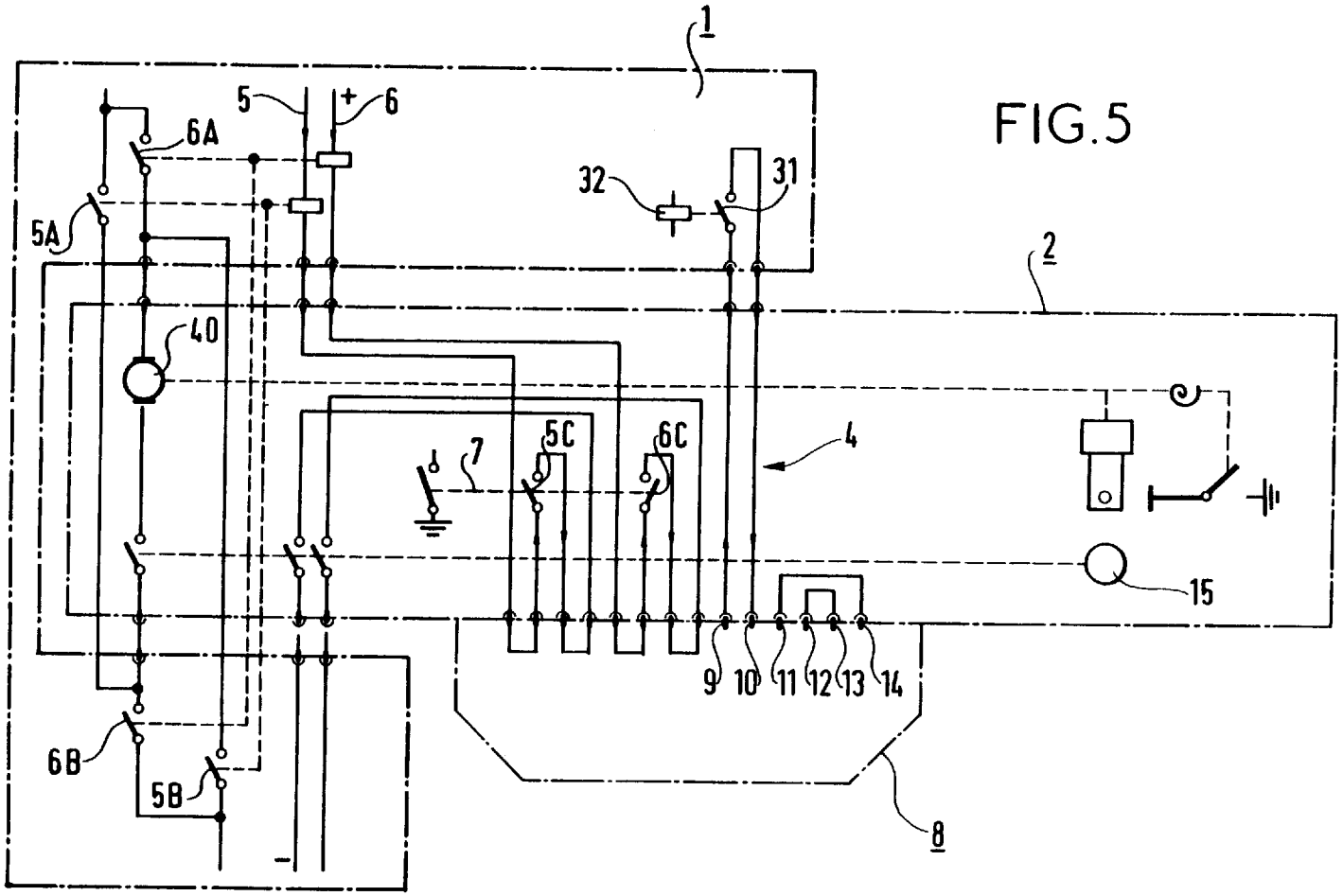
FIGS. 5 and 6 are electrical circuit diagrams of a preferred embodiment.
Figure 6:
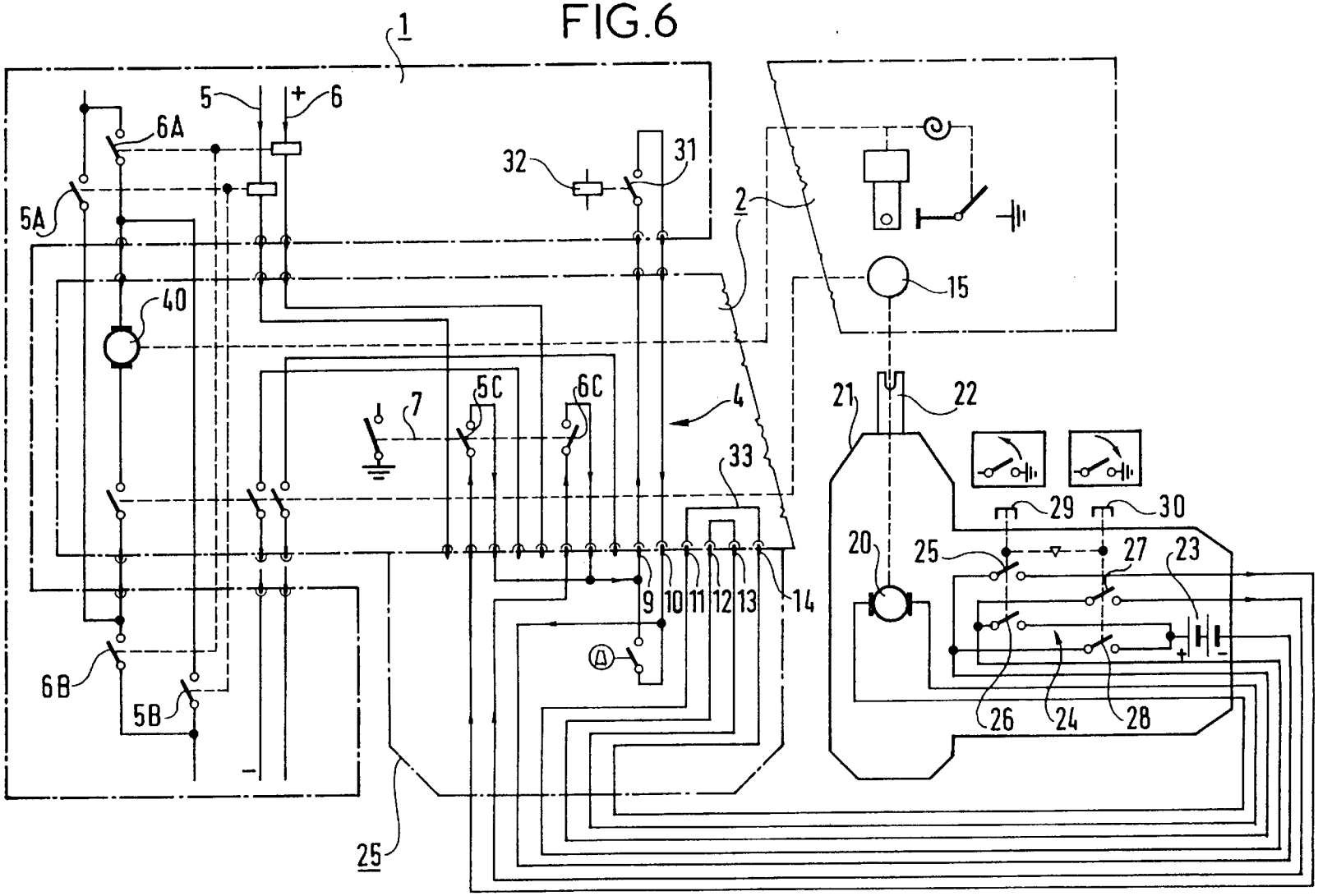

FIGS. 5 and 6 are electrical circuit diagrams of a preferred embodiment.

FIG. 5 shows the installation in normal operating mode. The control box 2 contains the fixed actuating motor 40, and the fixed-motor control circuit 4, and it is electrically connected to the local control cabinet 1.

The motor 40 is driven via the conductor 5 in one direction corresponding to the contacts of the equipment being opened, and via the conductor 6 in the other direction corresponding to the contacts of the equipment being closed. The electrical conductors 5, 6 actuate switches 5A, 5B, 6A, 6B connected in a circuit known per se controlling the rotation direction depending on which conductor is powered.

Furthermore, the conductors 5, 6 are extended so as to form the fixed-motor control circuit 4. For this purpose, each of them includes a contact 5C, 6C before they are connected to the other terminal of the control cabinet 1.

The contacts 5C and 6C are controlled via a circuit represented by the line 7 which represents the position-indicating circuit for indicating the positions of the contacts of the equipment. For example, the contact 5C may be opened once the contacts of the equipment have reached their fully open positions. The power supply to the motor 40 is then interrupted.

The above-described position-indicating circuit is known per se, and it is used to equip high-voltage electrical equipment of the section switch or grounding section switch type.

The invention consists in equipping the box 2 with a plug 8 which, in the normal operating position provides continuity for the conductors 5 and 6. In addition, according to the invention, the box is equipped with connector terminals 9 to 14 left open once the plug 8 is plugged in, and whose function is described below.

In conventional manner, the box 2 is equipped with a mechanical drive system 15 for actuating the contacts of the equipment by means of a back-up system in the event of a malfunction of the motor 40 or the like.

In the event that such a malfunction occurs, the plug 8 is unplugged and the back-up system is connected as shown in FIG. 6.

The back-up device includes a motor 20 housed in a casing of the power drill type, the motor 20 actuates a rod 22 of the crank rod type serving to co-operate with the mechanical drive system 15.

The motor 20 is powered by a self-contained source 23, preferably a battery, via a portable-motor control circuit 24 connected to a plug 25 plugged into the box in place of the plug 8.

The portable-motor control circuit 24 includes a set of switches, two of which switches 25, 26 are closed under the effect of a first push button 29 for opening the equipment contacts, the other two switches 27, 28 being closed under the effect of a second push button 30 for closing the equipment contacts. The portable-motor control circuit 24 has parallel branches, is the same type as that of the motor 40, and makes it possible to reverse the rotation direction depending on which push button is actuated.

By means of the plug 25, the following are interposed between said portable-motor control circuit and the motor 20:

the contact 5C connected to switches 25 and 26 of the control circuit 24;

the contact 6C connected to switches 27 and 28 of the portable-motor control circuit 24;

an optional switch 31 actuated by an operation enable locking relay 32 that is connected to the connector terminals 9 and 10; and straps 33 interconnecting the connector terminals 11 to 14 specific to the control box 2 and therefore to the equipment, and guaranteeing that the motor 20 rotates in the correct direction.

The portable motor 20 is thus controlled, similarly to the motor 40, by the contacts 5C and 6C of the fixed-motor control circuit 4. Once the contacts of the equipment are fully opened or fully closed, the power supply to the portable motor 20 is interrupted and the operation ceases.

The locking relay 32 disposed in the local control cabinet 1 can be connected by means of the connector terminals 9 and 10 in series to the preceding contact 5C or 6C. This relay provides operation enabling safety, thereby preventing any wrong operation from being enabled such as closing the equipment when it is switched on or under load.

The straps 33 determine the opening or closing rotation direction. This direction can vary depending on the control box 2, and it is thus possible to equip the back-up system with the two push buttons 29, 30 indicating simply and directly for the button 29 "open", and for the button 30 "close". The straps 33 may thus constitute forwards or reversing links. In this way, operators do not have to concern themselves with the actual rotation direction for closing or opening the equipment.

I claim:

1. A system for actuating electrical equipment, said system including, a control box, a rotary drive unit in said control box for driving contacts of the equipment, a control circuit in said control box including end-of-stroke contacts associated with the contacts of the equipment, said system further including a portable electric motor having a self-contained power supply, said electric motor being equipped with a mechanical coupling for mechanically coupling said electric motor to the rotary drive unit, and said rotary drive unit being provided with an electrical connector for connecting said rotary drive unit to said control circuit.

2. A system according to claim 1, wherein said electric motor is housed in a casing of the power drill type, and wherein said mechanical coupling is a rod of the crank rod type operatively couplable to the rotary drive unit of the control box.

3. A system according to claim 2, wherein said electrical connector is a first removable plug plugged into the control box, and connecting said control circuit to a portable-motor control circuit housed in the casing.

4. A system according to claim 3, wherein said portable-motor control circuit includes two push buttons for selectively causing the electric motor to rotate in one or the other rotation direction.

5. A system according to claim 3, wherein said control box further includes a link to a locking relay to said plug.

6. A system according to claim 3, wherein said control box further includes straps for determining the direction of motor operation, and connectable to said plug.

7. A system according to claim 1, wherein said control box further comprises a fixed electric motor, and said rotary drive unit constitutes a back-up device for actuating said electrical equipment in the event that a normal actuating unit including said fixed electric motor malfunctions.

8. A system according to claim 7, wherein said control box includes a second removable plug for normal operation, and wherein said second removable plug provides continuity for a fixed-motor control circuit including said fixed electric motor.

* * * * *